US012060720B2

(12) United States Patent
Manabe et al.

(10) Patent No.: US 12,060,720 B2
(45) Date of Patent: Aug. 13, 2024

(54) BINDING WIRE SUPPLY SYSTEM FOR REINFORCING BAR BINDING MACHINE

(71) Applicant: Ken Robotech Corp., Kagawa (JP)

(72) Inventors: Tatsuya Manabe, Kagawa (JP); Haruhisa Inoue, Kagawa (JP)

(73) Assignee: Ken Robotech Corp., Kagawa (JP)

( * ) Notice: Subject to any disclaimer, the term of this patent is extended or adjusted under 35 U.S.C. 154(b) by 439 days.

(21) Appl. No.: 17/509,009

(22) Filed: Oct. 24, 2021

(65) Prior Publication Data

US 2022/0145649 A1 May 12, 2022

(30) Foreign Application Priority Data

Nov. 12, 2020 (JP) ..... 2020-188631

(51) Int. Cl.
*B65B 13/18* (2006.01)
*E04G 21/12* (2006.01)

(52) U.S. Cl.
CPC ..... *E04G 21/123* (2013.01); *B65B 13/18* (2013.01)

(58) Field of Classification Search
CPC ..... B65B 13/04; B65B 13/18; B65B 13/28; B65B 27/06; B21F 15/06; B21F 27/08; B21F 31/00; E04C 5/18; E04G 21/12
See application file for complete search history.

(56) References Cited

U.S. PATENT DOCUMENTS

2005/0224131 A1* 10/2005 Ishii ..... B65B 13/187 140/2
2006/0254666 A1* 11/2006 Kusakari ..... E04G 21/122 140/57
2018/0126443 A1* 5/2018 Morijiri ..... E04G 21/122
2021/0156160 A1 5/2021 Manabe

FOREIGN PATENT DOCUMENTS

JP 06-226386 A 8/1994
JP 08-034405 A 2/1996
JP 2010-189055 A 9/2010
JP 6633720 B1 12/2019

* cited by examiner

*Primary Examiner* — Jimmy T Nguyen
(74) *Attorney, Agent, or Firm* — Renner, Otto, Boisselle & Sklar, LLP

(57) ABSTRACT

A binding wire supply system for a reinforcing bar binding machine for supplying binding wire to a reinforcing bar binding machine from the outside of the reinforcing bar binding machine that binds intersections of reinforcing bars with the binding wire, wherein the binding wire supply system includes a reel mounting unit on which a binding wire supply reel, which is arranged close to the reinforcing bar binding machine and supplies the binding wire to the reinforcing bar binding machine, is mounted; a binding wire adapter for introducing the binding wire supplied from the binding wire supply reel into a binding wire accommodating magazine of the reinforcing bar binding machine; and a binding wire insertion guide into which the binding wire is inserted from the reel mounting unit to guide the binding wire to the binding wire adapter.

5 Claims, 5 Drawing Sheets

BINDING WIRE SUPPLY SYSTEM FOR REINFORCING BAR BINDING MACHINE

TECHNICAL FIELD

The present invention relates to a binding wire supply system for a reinforcing bar binding machine for supplying binding wire to a reinforcing bar binding machine from the outside of the reinforcing bar binding machine that binds intersections of reinforcing bars with the binding wire.

BACKGROUND ART

Conventionally, a self-propelled robot for binding reinforcing bars is known, which includes a wheel unit for traveling on a plurality of reinforcing bars laid in a grid pattern on an operation surface, a frame unit on which the wheel unit is mounted, a reinforcing bar binding machine holding unit on which a reinforcing bar binding machine is detachably attached, a drive unit for driving up and down the reinforcing bar binding machine holding unit, and a control unit, and lowers the reinforcing bar binding machine mounted on the reinforcing bar binding machine holding unit to bind the intersections of reinforcing bars with binding wire (see the patent literature 1).

CITATION LIST

Patent Literature

[Patent Literature 1] JP 6633720 B1

SUMMARY OF INVENTION

Technical Problem

However, the reinforcing bar binding machine mounted on the conventional self-propelled robot for binding reinforcing bars stores the reel of the binding wire in the binding wire accommodating magazine and performs the binding operation. Thus, every time one reel runs out, it is necessary to stop the operation of the robot, and open the binding wire accommodating magazine of the reinforcing bar binding machine to replace the reel. Therefore, there is a problem that the work efficiency is low.

The present invention solves the problem of the prior art as described above, that is, the object of the present invention is to provide a binding wire supply system for a reinforcing bar binding machine that supplies the binding wire from the outside of the reinforcing bar binding machine to make it unnecessary to replace the reel in the binding wire accommodating magazine, and makes it possible to continuously perform the binding operation for a long time without being restricted by the capacity of the binding wire accommodating magazine.

Solution to Problem

In accordance with one aspect, the present invention is a binding wire supply system for a reinforcing bar binding machine for supplying binding wire to a reinforcing bar binding machine from the outside of the reinforcing bar binding machine that binds intersections of reinforcing bars with the binding wire, wherein the binding wire supply system includes a reel mounting unit on which a binding wire supply reel, which is arranged close to the reinforcing bar binding machine and supplies the binding wire to the reinforcing bar binding machine, is mounted; a binding wire adapter for introducing the binding wire supplied from the binding wire supply reel into a binding wire accommodating magazine of the reinforcing bar binding machine; and a binding wire insertion guide into which the binding wire is inserted from the reel mounting unit to guide the binding wire to the binding wire adapter. Thereby, the above-described problem can be solved.

According to another aspect, the reel mounting unit includes a reverse rotation prevention member. Thereby, the above-described problem can be solved.

According to another aspect, the binding wire adapter has a guide connecting portion for connecting the binding wire insertion guide. Thereby, the above-described problem can be further solved.

According to another aspect, the binding wire adapter includes a mounting base portion for being mounted and fixed to the binding wire accommodating magazine and a binding wire introduction pipe portion obliquely penetrating the mounting base portion. Thereby, the above-described problem can be further solved.

According to another aspect, the binding wire introduction pipe portion is, at a pipe end portion, diagonally open along a magazine peripheral wall in the binding wire accommodating magazine. Thereby, the above-described problem can be further solved.

According to another aspect, the binding wire insertion guide is formed of a contact coil spring into which binding wire is to be inserted. Thereby, the above-described problem can be further solved.

Advantageous Effect of Invention

According to an aspect of the invention, the binding wire supply system for a reinforcing bar binding machine supplies binding wire to a reinforcing bar binding machine from the outside of the reinforcing bar binding machine that binds intersections of reinforcing bars with the binding wire, wherein the binding wire supply system includes a reel mounting unit on which a binding wire supply reel, which is arranged close to the reinforcing bar binding machine and supplies the binding wire to the reinforcing bar binding machine, is mounted; a binding wire adapter for introducing the binding wire supplied from the binding wire supply reel into a binding wire accommodating magazine of the reinforcing bar binding machine; and a binding wire insertion guide into which the binding wire is inserted from the reel mounting unit to guide the binding wire to the binding wire adapter. Thus, the binding wire is supplied from the outside of the reinforcing bar binding machine, and it is not necessary to replace the reel in the binding wire accommodating magazine. Therefore, the binding operation can be continuously performed for a long time without being restricted by the capacity of the binding wire accommodating magazine.

According to another aspect, the reel mounting unit includes a reverse rotation prevention member. Thus, since the binding wire once pulled out by the binding operation of the reinforcing bar binding machine is not rewound and the margin is generated, the reinforcing bar binding machine can pull in the binding wire with a small force. Therefore, in addition the power consumption can be reduced and the wear of the machine can be prevented.

According to another aspect, the binding wire adapter has a guide connecting portion for connecting the binding wire insertion guide. Thus, since the binding wire guided in the binding wire insertion guide is smoothly introduced into the binding wire accommodating magazine via the binding wire adapter, and the binding wire is prevented from "unexpected motions", the reinforcing bar binding machine can pull in the binding wire with a small force. Therefore, in addition the power consumption can be reduced and the wear of the machine can be prevented.

According to another aspect, the binding wire adapter includes a mounting base portion for being mounted and fixed to the binding wire accommodating magazine and a binding wire introduction pipe portion obliquely penetrating the mounting base portion. Thus, the binding wire introduced into the binding wire accommodating magazine via the binding wire adapter is supplied by smoothly being moved in the existing binding wire accommodating magazine without interfering with the dummy reel. Therefore, in addition the stable binding operation with the binding wire can be ensured without improving the reinforcing bar binding machine.

According to another aspect, the binding wire introduction pipe portion is, at a pipe end portion, diagonally open along a magazine peripheral wall in the binding wire accommodating magazine. Thus, the binding wire introduced into the binding wire accommodating magazine via the binding wire adapter is reasonably directed and supplied along the magazine peripheral wall in the binding wire accommodating magazine. Therefore, in addition the binding wire can be smoothly and stably supplied to intersections of the reinforcing bars via the inside of the binding wire accommodating magazine.

According to another aspect, the binding wire insertion guide is formed of a contact coil spring into which binding wire is to be inserted. Thus, when the binding wire is pulled into the reinforcing bar binding machine, the binding wire insertion guide flexibly and elastically deforms. Therefore, in addition the binding wire can be held without being bent or hooked on surrounding objects, and the binding wire insertion guide can withstand friction when the binding wire is supplied.

DETAILED DESCRIPTION OF EXAMPLES

In the present invention, the specific aspect may be an arbitrary aspect as long as the binding wire supply system is composed of a reel mounting unit on which a binding wire supply reel, which is arranged close to the reinforcing bar binding machine and supplies the binding wire to the reinforcing bar binding machine, is mounted; a binding wire adapter for introducing the binding wire supplied from the binding wire supply reel into a binding wire accommodating magazine of the reinforcing bar binding machine; and a binding wire insertion guide into which the binding wire is inserted from the reel mounting unit to guide the binding wire to the binding wire adapter, thereby the binding operation can be continuously performed for a long time without being restricted by the capacity of the binding wire accommodating magazine.

That is to say, the reel mounting unit in the present invention is only needed to be arranged close to the reinforcing bar binding machine and supply the binding wire to the reinforcing bar binding machine. Thus, other than the configuration in which the reel mounting unit is fixed to the self-propelled robot for binding reinforcing bars, a person who holds the reinforcing bar binding machine by himself and performs the binding operation may wear the reel mounting unit on his waist or carry the reel mounting unit on his back.

Further, the binding wire adapter of the present invention is not only configured to be mounted and fixed to an introduction window of the binding wire accommodating magazine by using an adapter fixing piece, but also the binding wire adapter itself may be configured to be provided with an engaging fixing claw to be engaged and fixed to the introduction window.

Further, the binding wire insertion guide of the present invention is only needed to deform flexibly and elastically in a state where the binding wire inserted thereinto. Thus, the binding wire insertion guide may be composed of, other than a metal contact coil spring, a general coil spring, a metal flexible tube or other flexible tube.

EXAMPLE

Hereinafter, the configuration of a binding wire supply system 100 for a reinforcing bar binding machine in an example of the present invention will be described with reference to FIGS. 1 to 5B.

Figure 1:
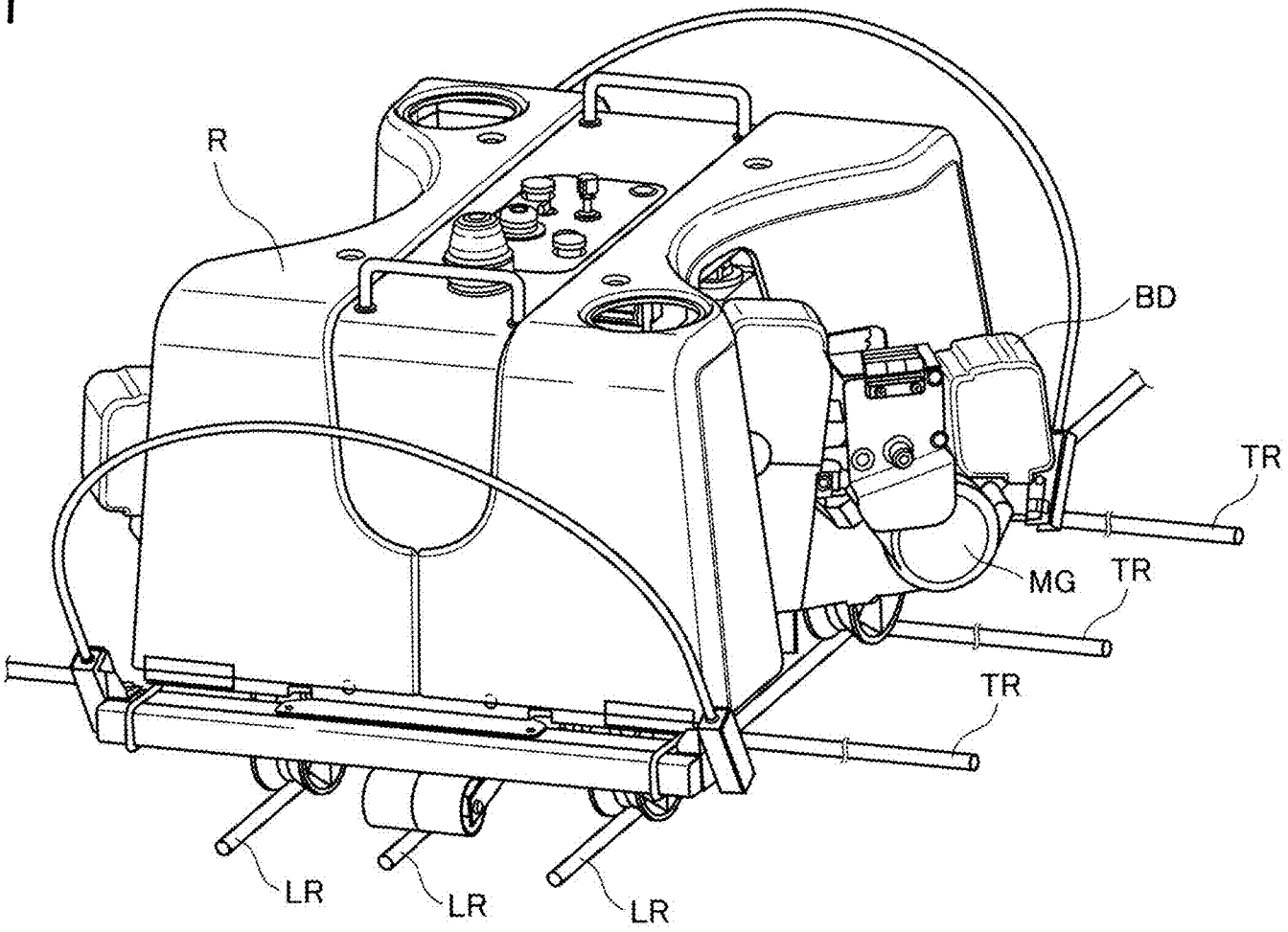
FIG. 1 is a schematic view illustrating an example of a self-propelled robot for binding reinforcing bars, to which the binding wire supply system for a reinforcing bar binding machine of the present invention can be applied.
Figure 2:
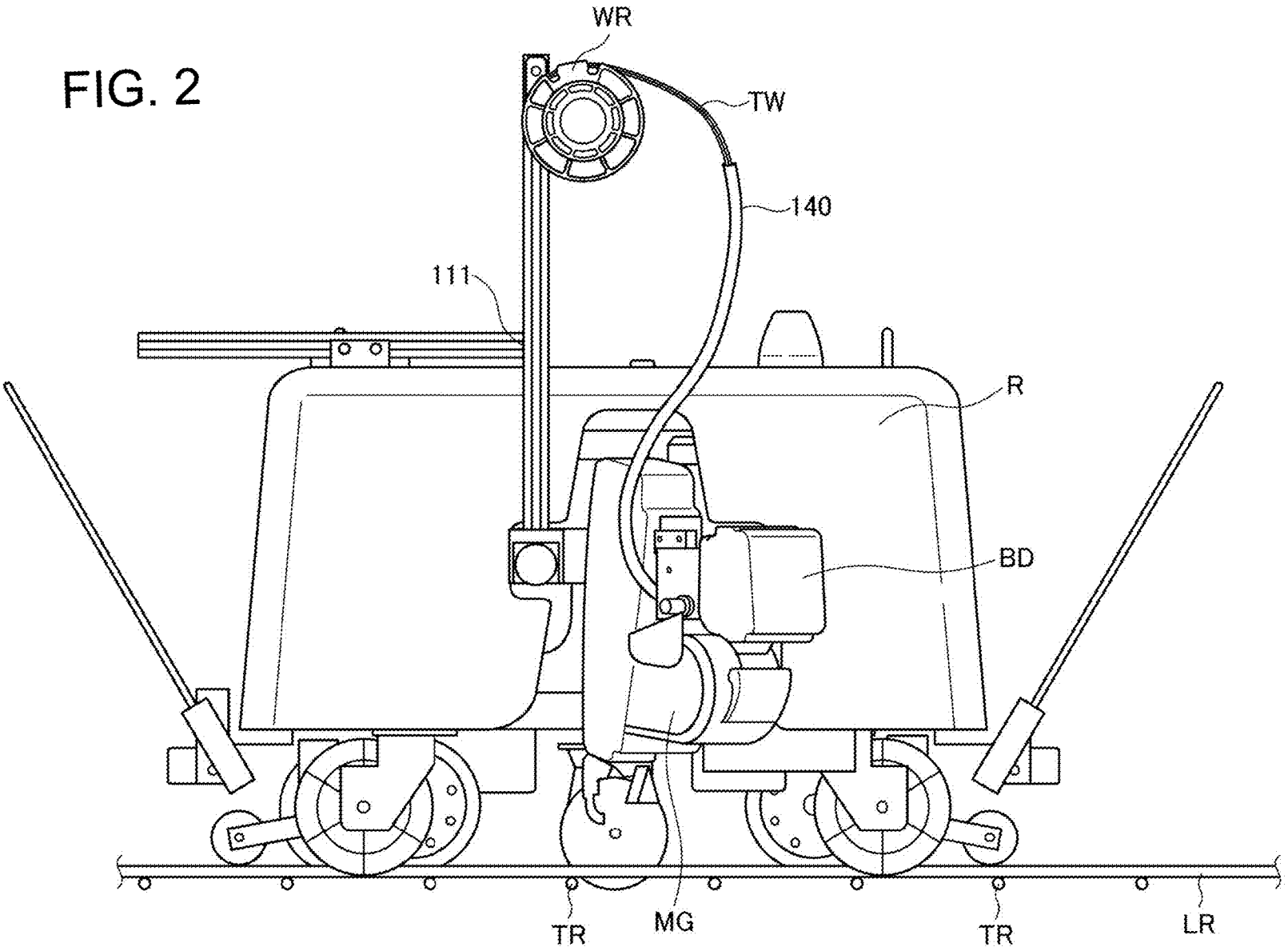
FIG. 2 is a schematic view illustrating an example of the present invention.
Figure 3:
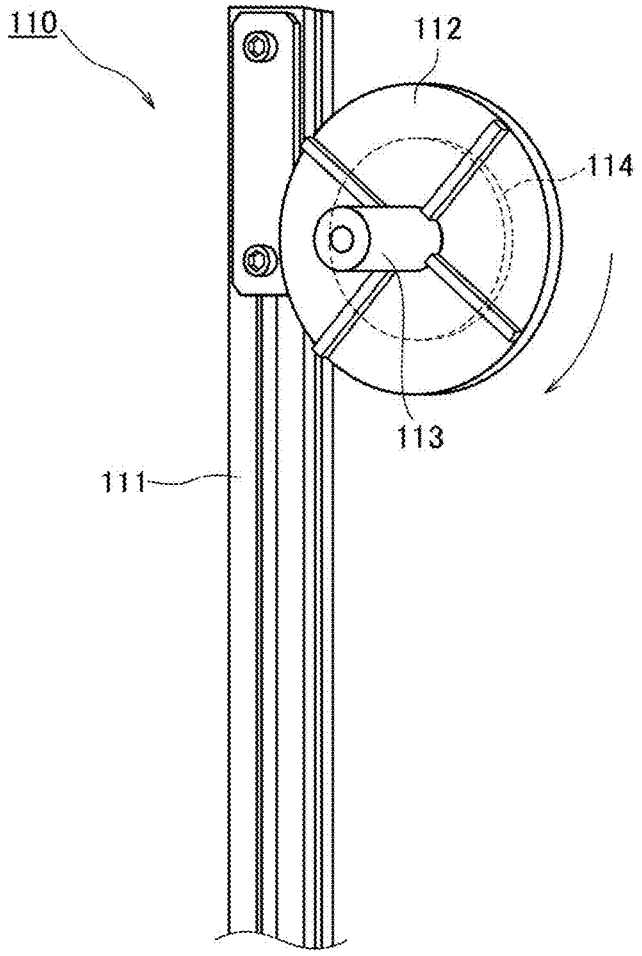
FIG. 3 is an explanatory view illustrating the operation of a reel mounting unit according to an example of the present invention.
Figure 4:
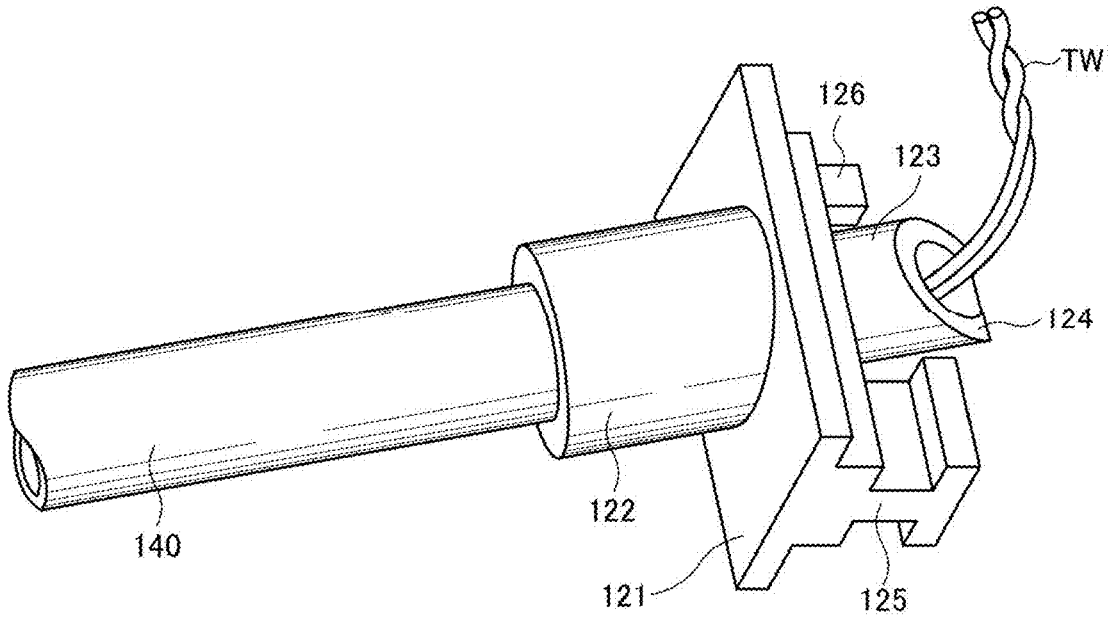
FIG. 4 is a schematic view illustrating a state where a binding wire insertion guide is inserted and fixed in a binding wire adapter according to an example of the present invention.
Figure 5A:
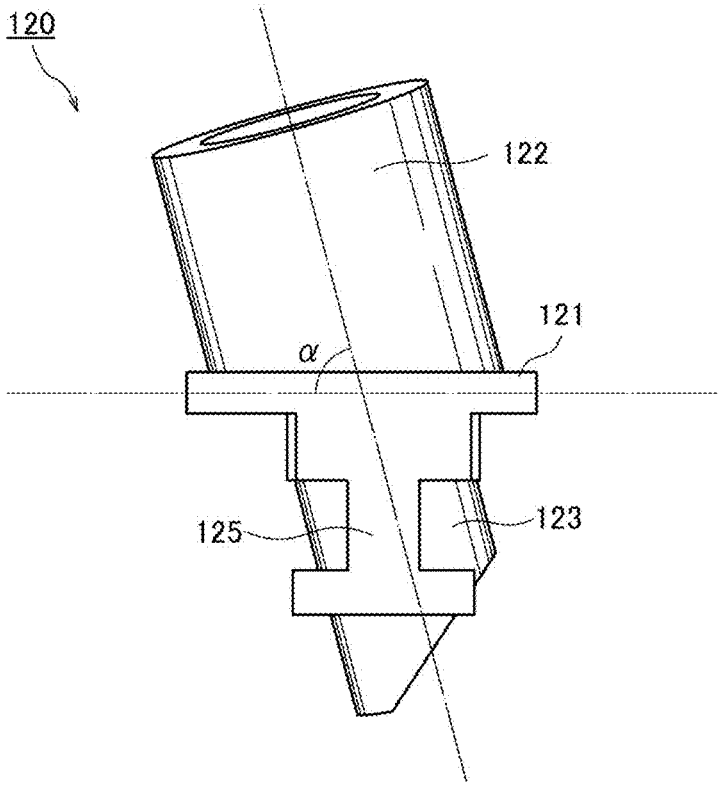
FIG. 5A is a schematic front view illustrating the binding wire adapter according to an example of the present invention.
Figure 5B:
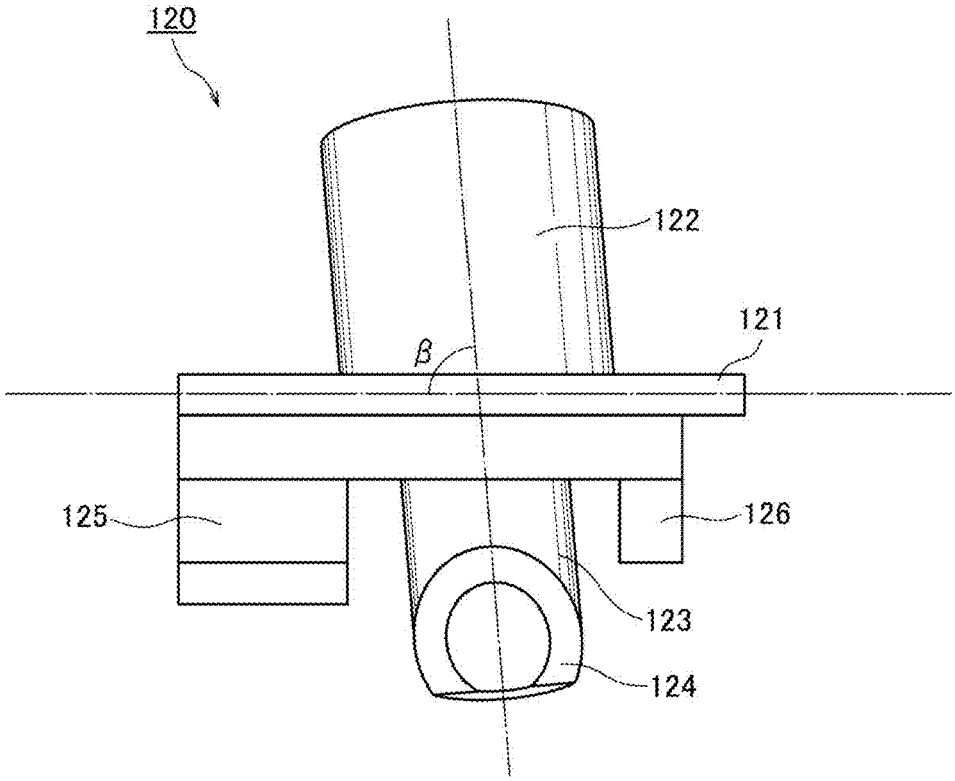
FIG. 5B is a schematic side view illustrating the binding wire adapter according to an example of the present invention.

Here, FIG. 1 is a schematic view illustrating an example of a self-propelled robot for binding reinforcing bars, to which the binding wire supply system for a reinforcing bar binding machine of the present invention can be applied, FIG. 2 is a schematic view illustrating an example of the present invention, FIG. 3 is an explanatory view illustrating the operation of a reel mounting unit according to an example of the present invention, FIG. 4 is a schematic view illustrating a state where a binding wire insertion guide is inserted and fixed in a binding wire adapter according to an example of the present invention, FIG. 5A is a schematic front view illustrating the binding wire adapter according to an example of the present invention, and FIG. 5B is a schematic side view illustrating the binding wire adapter according to an example of the present invention.

The binding wire supply system 100 for a reinforcing bar binding machine according to the present example is used for supplying binding wire TW from the outside of a reinforcing bar binding machine BD to the reinforcing bar binding machine BD mounted on the self-propelled robot R for binding reinforcing bars shown in FIG. 1.

The self-propelled robot R for binding reinforcing bars shown in FIG. 1 is equipped with the hand-held reinforcing bar binding machine BD, and moves the reinforcing bar binding machine BD up and down while self-propelling on traveling reinforcing bars LR arranged in parallel to bind intersections of the traveling reinforcing bars LR and orthogonal reinforcing bars TR, which are orthogonally arranged to the traveling reinforcing bars LR.

As shown in FIGS. 2 to 4, the binding wire supply system 100 for a reinforcing bar binding machine according to the present example includes a reel mounting unit 110, a binding wire adapter 120 and a binding wire insertion guide 140.

The reel mounting unit 110 includes a mounting frame 111, a mounting rotary plate 112, a mounting shaft 113 and a one-way clutch 114 as a reverse rotation prevention member.

The mounting frame 111 has a T-shape as a whole as shown in FIG. 2, and is fixed to the self-propelled robot R for binding reinforcing bars at a plurality of places thereof. Further, as shown in FIG. 3, the mounting rotary plate 112 is rotatably fixed near the upper end portion of the mounting frame 111.

The mounting rotary plate 112 is rotatably fixed near the upper end portion of the mounting frame 111 via the one-way clutch 114, and the mounting shaft 113 having a common rotation shaft to the mounting rotary plate 112 is provided at the center of the mounting rotary plate 112.

The one-way clutch 114 regulates the rotation direction to one direction, and in a state where a binding wire supply reel WR is mounted on the mounting shaft 113, the binding wire supply reel WR is rotated only in the direction for supplying the binding wire TW.

As shown in FIGS. 4 to 5B, the binding wire adapter 120 is provided with a mounting base portion 121, a guide connecting portion 122, a binding wire introduction pipe portion 123, a pipe end portion 124, a fitting protrusion portion 125 and an engaging protrusion piece portion 126.

The mounting base portion 121 has a plate-shaped structure having a shape and dimensions that just close an introduction window EW provided in a binding wire accommodating magazine MG of the reinforcing bar binding machine BD, to which the binding wire TW is supplied.

The cylindrical guide connecting portion 122 having a relatively large diameter is provided on one side of the mounting base portion 121, and the cylindrical binding wire introduction pipe portion 123 having a relatively small diameter is provided on the other side of the mounting base portion 121. The guide connecting portion 122 and the binding wire introduction pipe portion 123 are coaxially configured so that the inside of their pipe portions penetrates the mounting base portion 121.

The angle of the central axis, which is commonly included in the cylindrical guide connecting portion 122 and the binding wire introduction pipe portion 123, with respect to the mounting base portion 121 is deviated from the vertical. As shown in FIG. 5A, seen from the front of the binding wire adapter 120, the central axis is inclined so that the angle is $\alpha$ with respect to the flat surface of the mounting base portion 121. Furthermore, as shown in FIG. 5B, seen from the side of the binding wire adapter 120, the central axis is inclined so that the angle is $\beta$ with respect to the flat surface of the mounting base portion 121.

In the present example, $\alpha$ is set to about 75 degrees and $\beta$ is set to about 85 degrees.

The tip portion of the binding wire introduction pipe portion 123 is cut diagonally with respect to the central axis thereof to form the pipe end portion 124. As shown in FIGS. 5A and 5B, the flat surface forming the pipe end portion 124 is composed of a flat surface perpendicular to the front surface of the mounting base portion 121, i.e., perpendicular to the paper plane of FIG. 5A, so as to be widely open in the inclining direction of the binding wire introduction pipe portion 123.

At both ends of the mounting base portion 121 in the longitudinal direction on the side, on which the binding wire introduction pipe portion 123 is provided, the fitting protrusion portion 125 having a T-shaped cross section and the square columnar engaging protrusion piece portion 126 are provided with the binding wire introduction pipe portion 123 being therebetween.

Next, with reference to FIGS. 2, 4 and 6, the process for attaching the binding wire supply system 100 for a reinforcing bar binding machine according to the present example to the reinforcing bar binding machine BD to supply the binding wire TW into the reinforcing bar binding machine BD will be explained.

Figure 6:
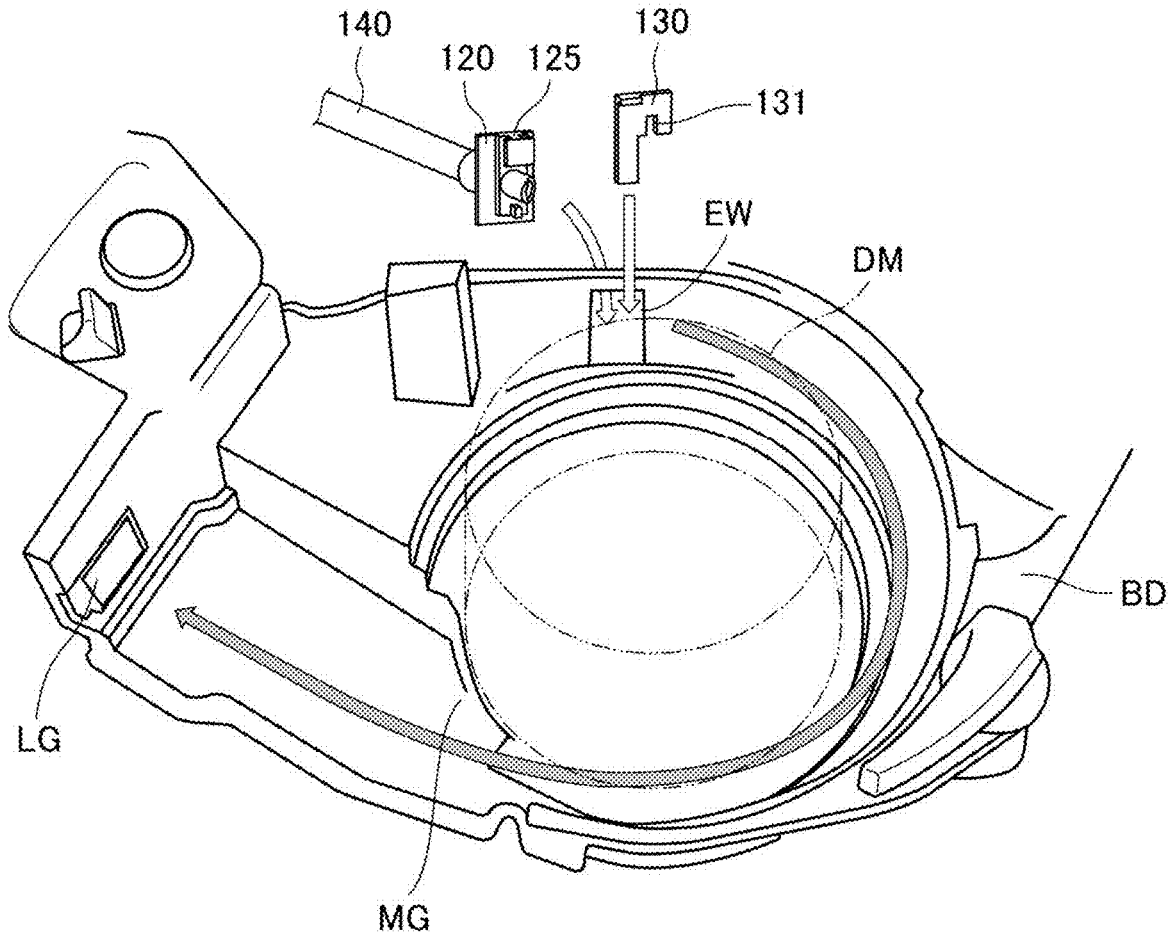
FIG. 6 is a schematic explanatory view illustrating a method for mounting the mounting base portion and a moving path of the introduced binding wire according to an example of the present invention.

Here, FIG. 6 is a schematic explanatory view illustrating a method for mounting the mounting base portion and a moving path of the introduced binding wire according to an example of the present invention, and for the sake of explanation, an opening/closing lid normally provided in the binding wire accommodating magazine MG of the reinforcing bar binding machine BD is omitted.

In order to mount the binding wire supply system 100 for a reinforcing bar binding machine according to the present example on the reinforcing bar binding machine BD and supply the binding wire TW into the binding wire accommodating magazine MG, first, as shown in FIG. 4, the binding wire insertion guide 140 is inserted into and fixed to the guide connection portion 122 of the binding wire adapter 120.

Next, as shown in FIG. 2, the binding wire TW is pulled out, which is winded and accommodated in the binding wire supply reel WR that is mounted on the mounting shaft 113 of the mounting rotary plate 112 constituting the reel mounting unit 110 and is rotatable together with the mounting rotary plate 112, and is inserted into the binding wire insertion guide 140. Then, as shown in FIG. 4, the binding wire TW coming out from the pipe end portion 124 of the binding wire introduction pipe portion 123 is slightly bent in the direction, in which the pipe end portion 124 is widely open, and the tip of the binding wire TW is twisted.

After that, as shown in FIG. 6, the binding wire adapter 120 is applied from the outside to the introduction window EW provided in the binding wire accommodating magazine MG of the reinforcing bar binding machine BD, and an adapter fixing piece 130 is arranged inside the binding wire accommodating magazine MG so that a fitting notch 131 of the adapter fixing piece 130 is fitted into the fitting protrusion portion 125 of the binding wire adapter 120. In this way, the binding wire adapter 120 is fixed to the introduction window.

Here, at a position in the binding wire accommodating magazine MG, at which a binding wire reel is to be arranged if the binding wire supply system 100 for a reinforcing bar binding machine of the present invention is not used, a cylindrical dummy reel DM similar to the binding wire reel is arranged. In this way, the binding wire TW introduced into the binding wire accommodating magazine MG is introduced, as shown by the shaded arrow in FIG. 6, along the side wall of the dummy reel DM, that is, along the peripheral wall in the binding wire accommodating magazine MG, and is supplied into a guide window LG to be used for binding reinforcing bars.

After the above preparations, if the self-propelled robot R for binding reinforcing bars is arranged on the traveling reinforcing bars LR as shown in FIG. 2 and the operation thereof is started, the self-propelled robot R for binding reinforcing bars moves the reinforcing bar binding machine BD up and down while traveling on the traveling reinforcing bars LR to bind intersections of the traveling reinforcing bars LR and the orthogonal reinforcing bars TR.

When the reinforcing bar binding machine BD reaches the lowermost position, the binding operation is performed. Here, the binding wire TW penetrating the binding wire insertion guide 140 is pulled into the binding wire accommodating magazine MG, so that the binding wire supply reel WR mounted on the mounting shaft 113 of the mounting rotary plate 112 of the reel mounting unit 110 is rotated in the forward direction together with the mounting rotary plate 112 to supply the binding wire TW.

When the binding operation is completed, the reinforcing bar binding machine BD returns to the uppermost position. Here, the mounting rotary plate 112 of the reel mounting unit 110 is restricted from rotating in the reverse direction by the one-way clutch 114, so that the binding wire supply reel WR mounted on the mounting shaft 113 of the mounting rotary plate 112 stops without rotating.

Therefore, a margin is generated in the drawn binding wire TW according to the raising distance of the reinforcing bar binding machine BD. However, the margin is absorbed by the deformation of the binding wire insertion guide 140 due to the flexibility and the elasticity thereof.

As described above, according to the binding wire supply system 100 for a reinforcing bar binding machine according to the present example, the system 100 is composed of the reel mounting unit 110 on which the binding wire supply reel WR, which is arranged close to the reinforcing bar binding machine BD and supplies the binding wire TW to the reinforcing bar binding machine BD, is mounted, the binding wire adapter 120 for introducing the binding wire TW supplied from the binding wire supply reel WR into the binding wire accommodating magazine MG of the reinforcing bar binding machine BD, and the binding wire insertion guide 140 into which the binding wire TW is inserted from the reel mounting unit 110 to guide the binding wire TW to the binding wire adapter 120. Thus, the binding wire TW is supplied from the outside of the reinforcing bar binding machine BD, and it is not necessary to replace the reel in the binding wire accommodating magazine MG. Therefore, the binding operation can be continuously performed for a long time without being restricted by the capacity of the binding wire accommodating magazine MG.

Further, the reel mounting unit 110 includes the one-way clutch 114 as a reverse rotation prevention member. Thus, since the binding wire TW once pulled out by the binding operation of the reinforcing bar binding machine BD is not rewound and the margin is generated, the reinforcing bar binding machine BD can pull in the binding wire TW with a small force. Therefore, the power consumption can be reduced and the wear of the machine can be prevented.

Further, the binding wire adapter 120 has the guide connecting portion 122 for connecting the binding wire insertion guide 140. Thus, since the binding wire TW guided in the binding wire insertion guide 140 is smoothly introduced into the binding wire accommodating magazine MG via the binding wire adapter 120, and the binding wire TW is prevented from "unexpected motions", the reinforcing bar binding machine BD can pull in the binding wire TW with a small force. Therefore, the power consumption can be reduced and the wear of the machine can be prevented.

Further, the binding wire adapter 120 includes the mounting base portion 121 for being mounted and fixed to the binding wire accommodating magazine MG and the binding wire introduction pipe portion 123 obliquely penetrating the mounting base portion 121. Thus, the binding wire TW introduced into the binding wire accommodating magazine MG via the binding wire adapter 120 is supplied by smoothly being moved in the existing binding wire accommodating magazine MG without interfering with the dummy reel DM. Therefore, the stable binding operation with the binding wire TW can be ensured without improving the reinforcing bar binding machine BD.

Further, the binding wire introduction pipe portion 123 is, at the pipe end portion 124, diagonally open along the magazine peripheral wall in the binding wire accommodating magazine MG. Thus, the binding wire TW introduced into the binding wire accommodating magazine MG via the binding wire adapter 120 is reasonably directed and supplied along the magazine peripheral wall in the binding wire accommodating magazine MG. Therefore, the binding wire TW can be smoothly and stably supplied to intersections of the reinforcing bars via the inside of the binding wire accommodating magazine MG.

Further, the binding wire insertion guide 140 is formed of a contact coil spring into which the binding wire TW is to be inserted. Thus, when the binding wire TW is pulled into the reinforcing bar binding machine BD, the binding wire insertion guide 140 flexibly and elastically deforms. Therefore, the binding wire TW can be held without being bent or hooked on surrounding objects, and the binding wire insertion guide 140 can withstand friction when the binding wire TW is supplied.

REFERENCE SIGNS LIST

100 binding wire supply system for a reinforcing bar binding machine
110 reel mounting unit
111 mounting frame
112 mounting rotary plate
113 mounting shaft
114 one-way clutch (reverse rotation prevention member)
120 binding wire adapter
121 mounting base portion
122 guide connecting portion
123 binding wire introduction pipe portion
124 pipe end portion
125 fitting protrusion portion
126 engaging protrusion piece portion
130 adapter fixing piece
131 fitting notch
140 binding wire insertion guide
TR orthogonal reinforcing bar
LR traveling reinforcing bar
R self-propelled robot for binding reinforcing bars
BD reinforcing bar binding machine
MG binding wire accommodating magazine
EW introduction window
WR binding wire supply reel
TW binding wire
DM dummy reel
LG guide window

The invention claimed is:

1. A binding wire supply system for a reinforcing bar binding machine for supplying binding wire to a reinforcing bar binding machine from the outside of the reinforcing bar binding machine that binds intersections of reinforcing bars with the binding wire, wherein the binding wire supply system comprises a reel mounting unit on which a binding wire supply reel, which is arranged close to the reinforcing bar binding machine and supplies the binding wire to the reinforcing bar binding machine, is mounted;

a binding wire adapter for introducing the binding wire supplied from the binding wire supply reel into a binding wire accommodating magazine of the reinforcing bar binding machine, wherein the binding wire adapter includes a mounting base portion for being mounted and fixed to the binding wire accommodating magazine and a binding wire introduction pipe portion obliquely penetrating the mounting base portion; and a binding wire insertion guide into which the binding wire is inserted from the reel mounting unit to guide the binding wire to the binding wire adapter.

2. The binding wire supply system according to claim 1, wherein the reel mounting unit includes a reverse rotation prevention member.

3. The binding wire supply system according to claim 1, wherein the binding wire adapter has a guide connecting portion for connecting the binding wire insertion guide.

4. The binding wire supply system according to claim 1, wherein the binding wire introduction pipe portion is, at a pipe end portion, diagonally open along a magazine peripheral wall in the binding wire accommodating magazine.

5. The binding wire supply system according to claim 1, wherein the binding wire insertion guide is formed of a contact coil spring into which binding wire is to be inserted.

* * * * *